US005317367A

United States Patent [19]

Pierce et al.

[11] Patent Number: 5,317,367

[45] Date of Patent: May 31, 1994

[54] THERMAL REALTIME CLOCK

[75] Inventors: Daniel J. Pierce, Rochester; William P. Reese, Pittsford, both of N.Y.

[73] Assignee: Xerox Corporation, Stamford, Conn.

[21] Appl. No.: 3,055

[22] Filed: Jan. 11, 1993

[51] Int. Cl.[5] ..... G03G 21/00

[52] U.S. Cl. ..... 355/203; 355/204; 355/205; 355/206; 355/208; 355/285

[58] Field of Search ..... 355/200, 202–208, 355/282, 285, 289, 290; 219/216

[56] References Cited

U.S. PATENT DOCUMENTS

| | | | |
|---|---|---|---|
| 3,849,628 | 11/1974 | Abowitz et al. | 219/216 |
| 3,893,175 | 7/1975 | Soloman | 355/202 X |
| 4,318,612 | 3/1982 | Brannan et al. | 355/289 |
| 4,556,310 | 12/1985 | Masuda | 355/202 |
| 4,668,075 | 5/1987 | Shigemura et al. | 355/206 |
| 4,801,974 | 1/1989 | Suto et al. | 219/216 X |
| 4,870,526 | 9/1989 | Maruta et al. | 355/206 X |
| 4,881,101 | 11/1989 | Sumida | 355/204 |
| 4,958,188 | 9/1990 | Miyamoto | 355/206 |
| 5,021,827 | 6/1991 | Komiya et al. | 355/206 |
| 5,023,631 | 6/1991 | Neyishi et al. | 355/206 X |
| 5,038,319 | 8/1991 | Carter et al. | 395/700 |
| 5,087,941 | 2/1992 | Smith | 355/204 |
| 5,170,397 | 12/1992 | Hurtz et al. | 355/204 X |

*Primary Examiner*—Matthew S. Smith
*Attorney, Agent, or Firm*—Oliff & Berridge

[57] ABSTRACT

A reprographic machine having a plurality of operating subsystems employs a setup procedure that prevents use for copying until all subsystems reach operating conditions. To avoid the need for time lost in the setup procedure where a power shut down is short, a bypass system, which senses the duration of the shut down, is utilized to allow prompt return to the copy function. Heated elements, such as fuser rolls, motors, and the like can be utilized to provide a timing function, based on temperature decay characteristics relative to time. The sensed temperature can be used as a control parameter for allowing bypass of the setup procedures.

8 Claims, 5 Drawing Sheets

THERMAL REALTIME CLOCK

BACKGROUND OF THE INVENTION

1. Field of the Invention

This invention relates to setup systems for machinery having a plurality of subsystems. The invention relates particularly to such setup systems for reprographic machines and more particularly to systems for bypassing such setup systems.

2. Description of Related Art

Many types of machinery having a plurality of subsystems, particularly reprographic machines, include lengthy setup systems that are initiated when the equipment is first turned on to assure that all of the subsystems are in operational condition prior to use of the machine, for example, to make copies. These setup systems are normally implemented in process control algorithms resident in the operating software of the machine. Particularly, these process control algorithms are uncertain of how long the machine has been turned off. Thus the machine cannot determine whether there has been a lengthy shut down, extending for hours or days, or a momentary shut down, extending for 5–30 seconds. The shut down creates the need for the photoreceptor and development system to undergo a rest/recovery cycle and if this time of recovery is unknown, then, to ensure copy quality, a full set up procedure must occur prior to making a copy, whenever the machine is turned on, even if the duration of the shut down is only a few seconds.

This is disadvantageous because there are many instances when a software anomaly will occur which is difficult to clear through normal machine commands. Under these circumstances, it is common to momentarily turn the reprographic machine off so that the software systems will be reinitialized and the machine will be ready to make copies when it is turned back on. Under these conditions, the subsystems such as the photoreceptor and the fuser are substantially at operating conditions and normal copying could commence. However, the process control algorithms do not recognize this condition and require the machine to cycle through a full setup procedure. This results in postponing the availability of the machine to make copies, thereby resulting in loss of production by reason of unnecessary down time. Operator frustration also occurs because of an unnecessary waiting period before copies can be made.

SUMMARY OF THE INVENTION

According to the invention, the period of time during which a machine is turned off is determined and when the power is turned back on, a determination is made if the length of the shut down period is short, thereby allowing normal setup systems to be bypassed, or long, thereby requiring partial or complete setup processes to take place before further operation of the machine is enabled. The determination of the duration of the shut down period can be made by detecting the temperature of a heated mass constituting a part of one of the subsystems of the machine.

DESCRIPTION OF PREFERRED EMBODIMENTS

The following description of preferred embodiments is in the context of reprographic machines. However, it should be recognized that the invention has applicability to a wide range of equipment and machines which incorporate a setup routine prior to availability of the machine for performing its intended function.

Figure 1:
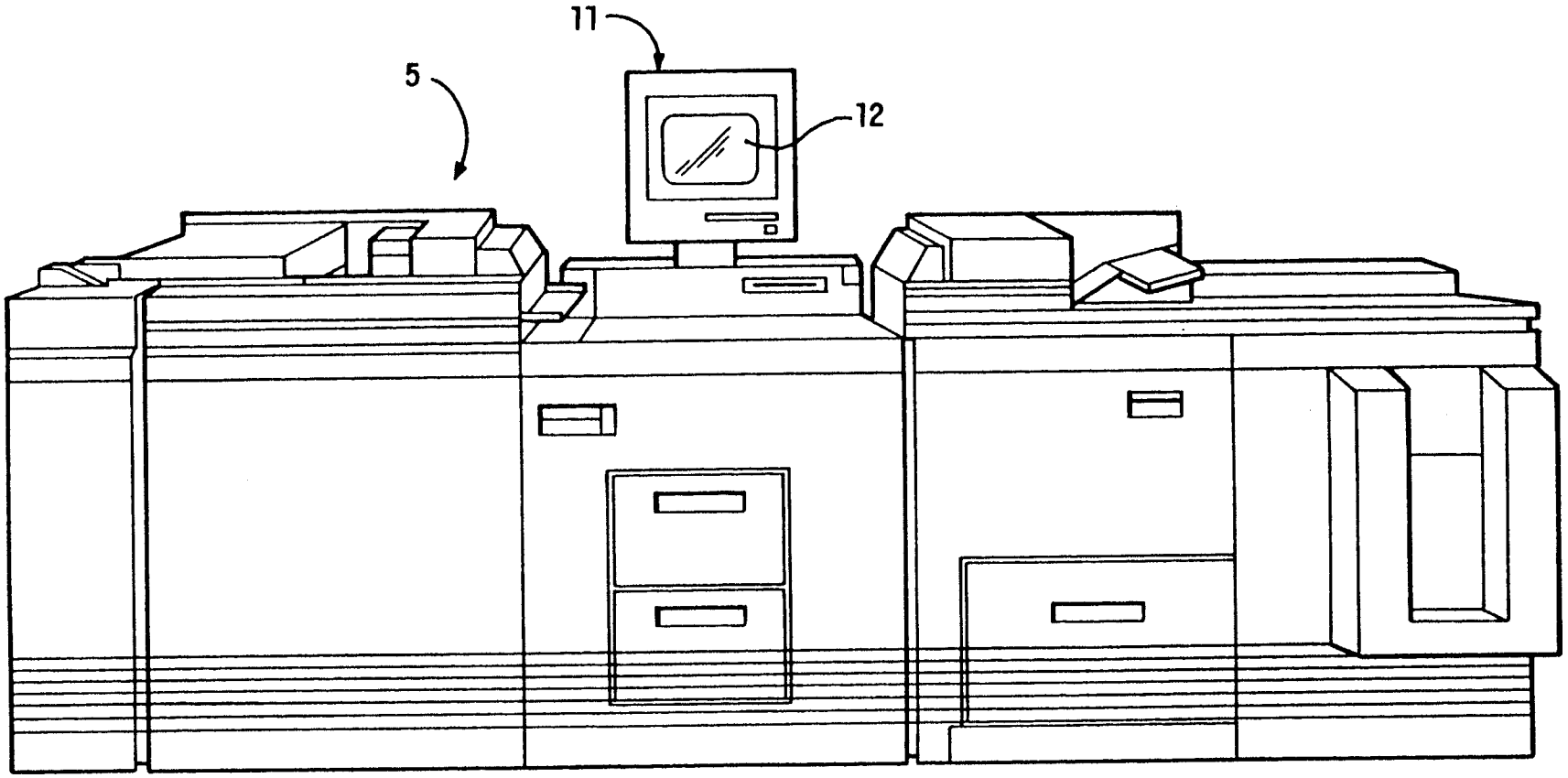
FIG. 1 is an illustration of a typical reprographic machine capable of utilizing the invention.
Figure 2:
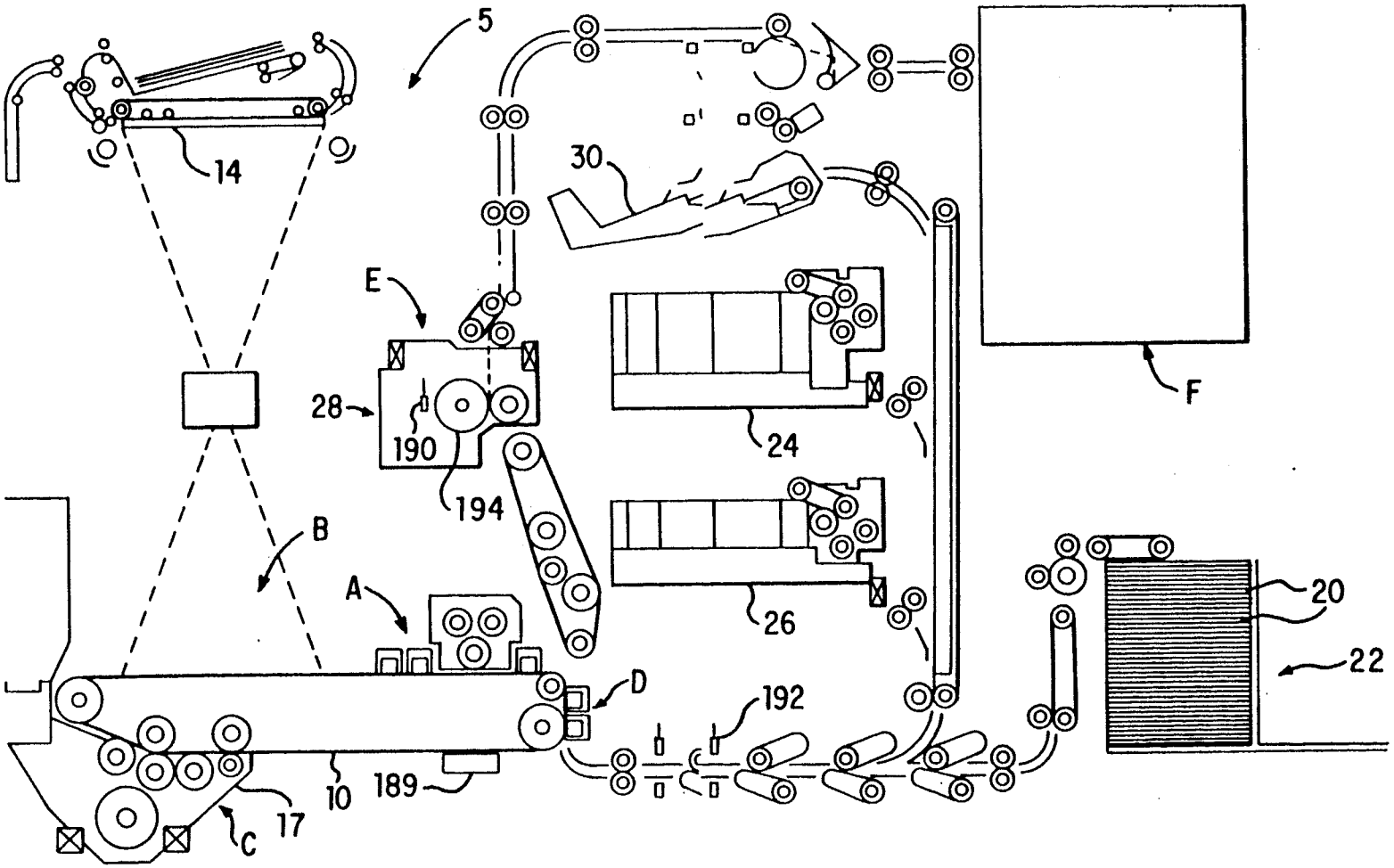
FIG. 2 illustrates internal subsystems of the reprographic machine shown in FIG. 2.

For a general understanding of the features of the present invention, reference is made to the drawings. In the drawings, like reference numerals have been used throughout to identify identical elements. Referring to FIGS. 1 and 2, there is shown an electrophotographic reproduction machine 5 composed of a plurality of programmable components and subsystems which cooperate to carry out the copying or printing job programmed through a touch dialogue screen 12 of a User Interface (U.I.) 11.

Machine 5 has a photoreceptor in the form of a movable photoconductive belt 10 which is charged at charging station A to a relatively high, substantially uniform potential. Next, the charged photoconductive belt is advanced through imaging station B where light rays reflected from the document being copied on platen 14 create an electrostatic latent image on photoconductive belt 10.

The electrostatic latent image is developed at development station C by a magnetic brush developer unit 17 and the developed image transferred at transfer station D to a copy sheet 20 supplied from tray 22, 24, or 26. Following transfer, the copy sheet bearing the transferred image is fed to fusing station E where a fuser 28 permanently affixes the toner powder image to the copy sheet. After fusing, the copy sheets are fed to either finishing station F or to duplex tray 30 from where the sheets are fed back to transfer station D for transfer of the second toner powder image to the opposed sides of the copy sheets.

Figure 3:
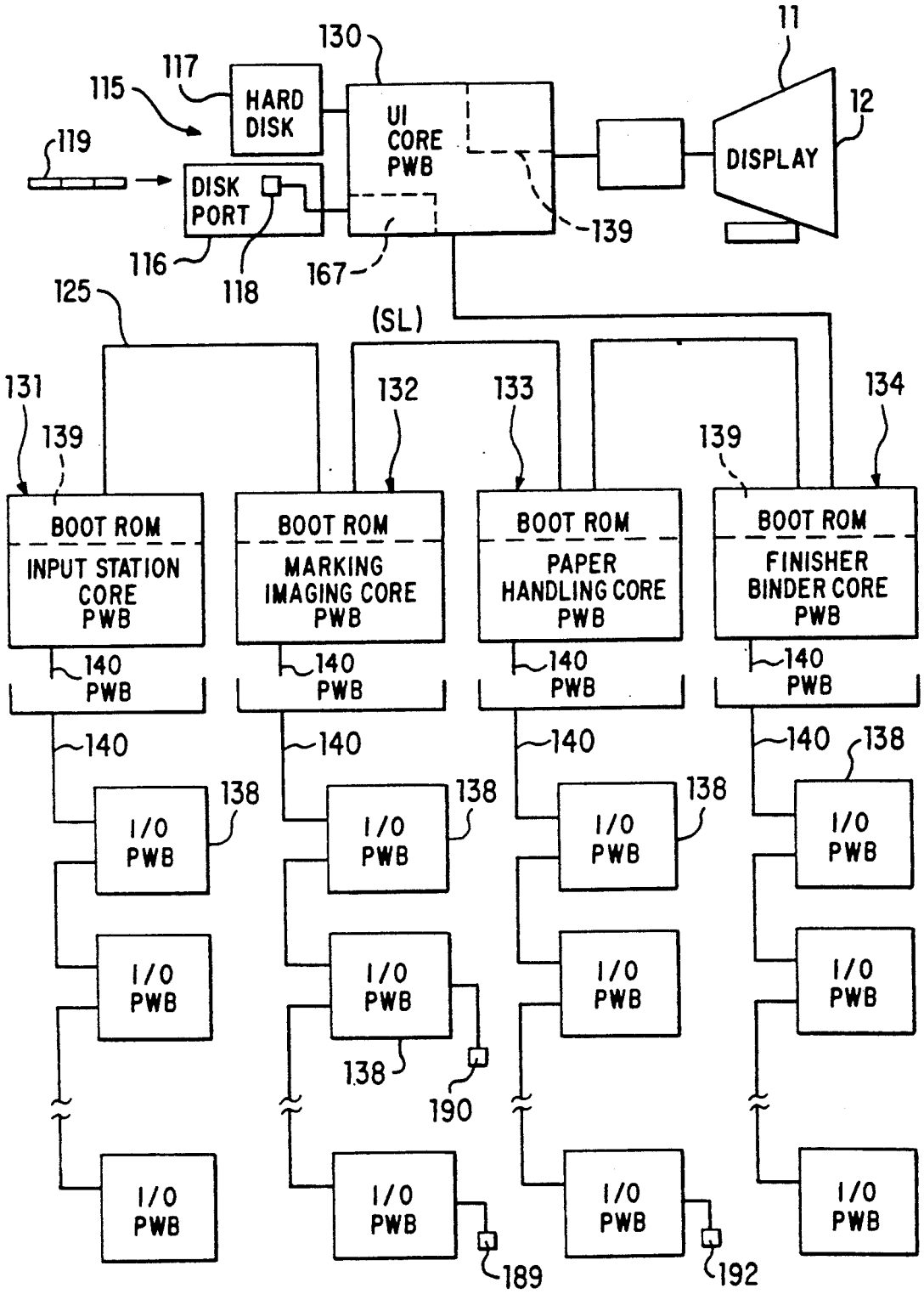
FIG. 3 is a schematic illustration of the control system of the reprographic machine shown in FIGS. 1 and 2.

Referring to FIG. 3, operation of the various components of machine 5 is regulated by a control system which uses operating software stored in memory 115 to operate the various machine components in an integrated fashion to produce copies and prints. The control system includes a plurality of printed wiring boards (PWBs), there being a UI core PWB 130, an Input Station core PWB 131, a Marking Imaging core PWB 132, a Paper Handling core PWB 133, and a Finisher Binder core PWB 134 together with various Input/Output (I/O) PWBs 138. A Shared Line (SL) 125 couples the core PWBs 130, 131, 132, 133, 134 with each other and with memory 115 while local busses 140 serve to couple the I/O PWBs 138 with each other and with their associated core PWB. Programming and operating control over machine 5 is accomplished through touch dialogue screen 12 of UI 11. The operating software includes applications software for implementing and coordinating operation of the machine components. Microprocessor in the core PWBs 130, 131, 132, 133 and 134 are provided to run the software and provide control, timing and other signals necessary for machine operation.

Memory 115 includes a main memory in the form of a hard or rigid disk (not shown) on which the machine operating software is stored. On machine power up, the operating software is loaded from memory 115 to UI core PWB 130 and from there to the remaining core PWBs 131. Additional ROM, RAM, and NVM memory types are resident at various locations within machine 5, with each core PWB 130, 131, 132, 134 having a boot ROM 139 for controlling downloading of operating software to the PWB, fault detection, etc. A NVM 167 is provided in UI core PWB 130. Boot ROMs 139 also enable transmission of operating software and control data to and from PWBs 130, 131, 132, 134 via SL 125 and control data to and from I/O PWBs 138 via local buses 140.

Certain machine operating parameters such as photoreceptor belt charge levels, fuser temperatures, etc. are permanently stored in NVM 167. These parameters represent the optimum or ideal operational settings for the machine which will result in the best possible machine performance. Typically, these operating parameters provide an operating range or window. Suitable sensors (shown also in FIG. 2) such as an Electrostatic Voltmeter (ESV) 189 for sensing photoreceptor charge levels, temperature sensor 190 for sensing the operating temperatures of fuser 28, sheet jam detectors 192 for detecting sheet jams and determining sheet timing, etc. monitor actual machine operating conditions. At discrete times during the operating cycles of machine 10, the sensors such as ESV 189, temperature sensor 190, jam detectors 192, etc. are read and the data obtained input via line 177.

Typically the reprographic machine 5 includes a main power on/off switch (not shown) which is disposed at an appropriate location on the reprographic machine for actuation by an operator to power up or shut down the reprographic machine 5 by interrupting the power supply to it. Resident in the U.I. core 130, or elsewhere in machine 5, is a setup system, preferably implemented in software, which prevents operation of machine 5 until the setup system is run to assure that all of the subsystems represented by cores 130, 131, 132, 133 and 134 have reached initial conditions, so that good quality copies can be made. The setup system includes interrogation of the various subsystems to determine clearance of the paper path (through core 133 via sensors, such as sensor 192), to determine whether the photoreceptor has reached a sufficient charge state (through core 132 and sensor 189) and to determine whether the fuser roll 194 has reached operating temperature, via core 132 and sensor 190). The illumination subsystem is monitored to determine if there is sufficient light to discharge the photoreceptor. Also, the development subsystem (which generates a development patch of toner on the photoreceptor) is monitored for voltage bias to ensure proper toner density. When the setup system has completed its cycle, reprographic machine can be enabled for operation by, for example, displaying the appropriate start icon on the touch dialogue screen 12 of U.I. 11. However, where the shut down of the machine has been temporary, for example for reinitializing to overcome a software fault, various parameters such as the photoreceptor charge and the fuser temperature may remain substantially at operating levels. Under these conditions, it is not necessary to undergo a setup routine before enabling the resumption of copying by the reprographic machine 5. Even if the shut down period is more than a momentary interruption, for example on the order of 30 seconds-one minute, only one or two subsystems, such as the temperature of fuser roll 194, may be below operating conditions, thereby requiring only a partial setup procedure.

In order to develop a measure of the time of the power off condition, it has been found possible to use a thermally instrumented heated mass formed by a part of one of the subsystems of the reprographic machine 5. For this purpose, the fuser roll 194 is particularly adaptable because it is heated to a temperature above ambient, has a sufficient mass and specific heat to act as a heat sink, and normally includes a sensor 190, for example a thermistor, for sensing the surface temperature of the roll. The particular design of such a roll is not the subject matter of this invention. A fuser roll such as illustrated in U.S. Pat. No. 3,849,628 (which is incorporated by reference herein) can be used. Alternatively, other elements, such as motors, which normally operate above ambient temperatures within the reprographic machine 5 can be utilized if equipped with an appropriate temperature sensing system.

Figure 6:
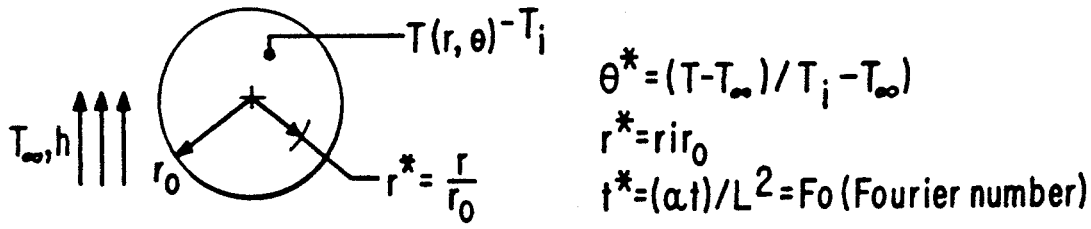
FIG. 6 is a diagram showing determination of temperatures in a heated cylinder.

Referring to FIG. 6, the cooling characteristics, i.e., temperature decay, of a fuser roll can be approximated under the laws of free convection of radial systems wherein the temperature T at any time is a function of the radial distance r from the center line, a temperature gradient $\Theta$ and initial temperature $T_i$. In FIG. 6, $T_\infty$ represents the ambient temperature and h represents thermal conductivity. For analysis purposes, $\theta^*=(T-T_\infty)/(T_i-T_\infty)$; $r^*=r/r_0$ (where $r_o$ is the radius of the cylinder) and $T^*=(\alpha t)/L^2=Fo$ (where $\alpha$ is a thermal diffusivity constant, t is time, L is the length of the cylinder and Fo is the Fourier number).

Figure 7:
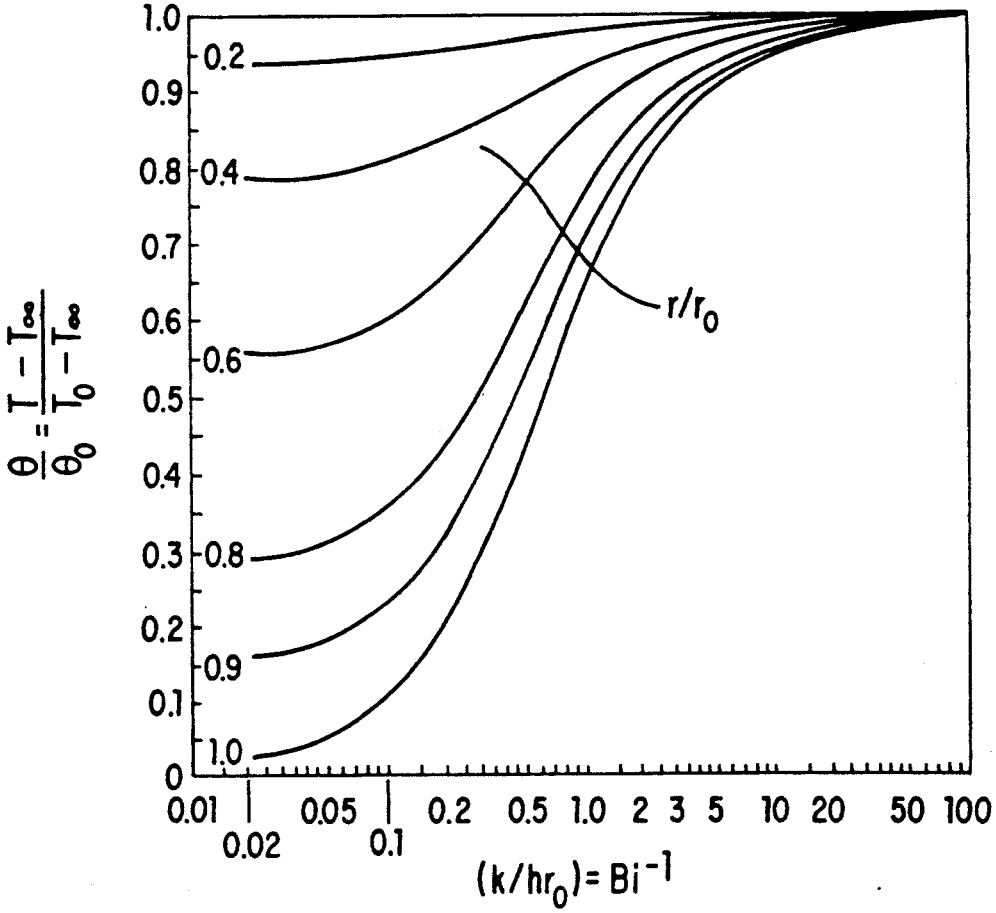
FIG. 7 is a graphical representation of temperatures within a cylinder under condition of convection heat loss, primarily as a function of time.

For an infinite cylinder which is at an initial uniform temperature $T_i$ and which experiences a change in convective conditions, an exact series solution may be obtained for the time dependence of the radial temperature distribution. A one term approximation may be used for most conditions and that approximation may be conveniently represented in graphical form, as shown in FIG. 7.

The one term approximation for the infinite cylinder is:

$$\theta^*=\theta^*_o J_o(\xi_1 r^*) \qquad \text{(Eq. 1)}$$

where $\xi_1$ is an eigenvalue, $J_o$ is a Bessel function and, $\theta^*_o$ represents the centerline temperature.

The centerline temperature is given by the expression:

$$\theta^*_o=C_1\exp(-\xi_1^2 Fo) \qquad \text{(Eq. 2)}$$

where the values of the coefficients $C_1$ and $\xi_1$ are available from standard tables for a range of biot numbers.

Substituting for $\theta^*$, $\theta^*_o$ and Fo in equation 2, the relationship between the fuser temperature, T, and the time it takes to reach that temperature, t, is determined according to the following relationship:

$$(T-T_\infty)/(T_i-T_\infty)=C_1\exp(-\xi_1^2(\alpha t)/L^2)J_o(\xi_1 r^*). \quad \text{(Eq. 3)}$$

Graphical representations in the form of Heisler Charts, as shown in FIG. 7, have also been generated. By determining the value of T from thermistor 190, the time duration of the shut off can be determined, as the initial temperature $T_i$ is known (it is the normal operating temperature of the surface fuser roll 194).

As can be seen from FIG. 7, using the lowermost curve ($r/r_0=1.0$) yields the surface temperature decay characteristics for a cylinder. A threshold time duration, during which the reprographic machine can be shut off, after reaching normal operating conditions, and yet maintain an operating state, can be determined empirically for the machine being controlled. In an electrophotographic reproduction machine as illustrated in FIGS. 1-3 a typical threshold time duration is about 0 to about 90 minutes under normal room conditions. Using this threshold time in Equation 3 or to determine the appropriate point on the abscissa of the graph in FIG. 7, a temperature T, for the surface of the fuser roll, 194 can be determined that corresponds to the threshold time (as the ambient $T_\infty$ is known or can be determined by measurement and the initial temperature $T_o$ is the target operating surface temperature of fuser roll 194).

Figure 4:
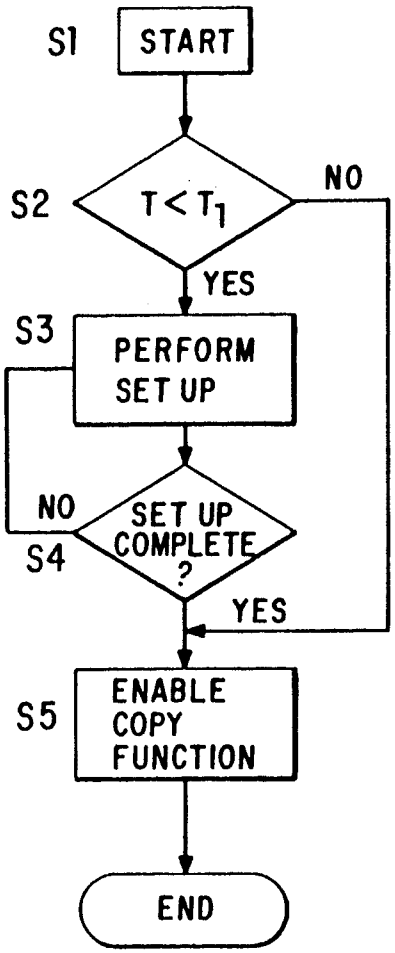
FIG. 4 is a logic diagram of one embodiment of bypass system embodying the invention.

FIG. 4 shows one embodiment of a bypass procedure for determining if the normal setup routine should be bypassed to enable immediate copying of documents. At step S1, the reprographic machine 5 is powered up, as by activation of the power on/off switch. Processing proceeds to S2 wherein a determination is made if the temperature T of the fuser roll 194 (measured by sensor 190) is less than a predetermined temperature T1. The temperature $T_1$ is determined on the basis of the calculation or determination explained above. If the determination at S2 is affirmative, processing proceeds to S3 wherein the normal setup system or routine is followed and the reprographic machine is brought to initial conditions suitable for operation. Processing then flows to step S4 wherein an inquiry is made as to whether the setup has been completed. If a negative determination is made at S4, processing returns to S3 for completion of the setup routine. If the determination at S4 is positive, processing proceeds to S5, wherein the copy function is enabled by, for example, display of the appropriate START icon on the screen 12 of U.I. 11.

However, if a negative determination is made at step S2, indicative of the fact that the temperature T sensed by sensor 190 is above $T_1$ and, thus, that the reprographic machine 5 has not been off for more than the predetermined period of time, processing flows directly to step S5, bypassing the setup system, and enabling the copy function.

Figure 5:
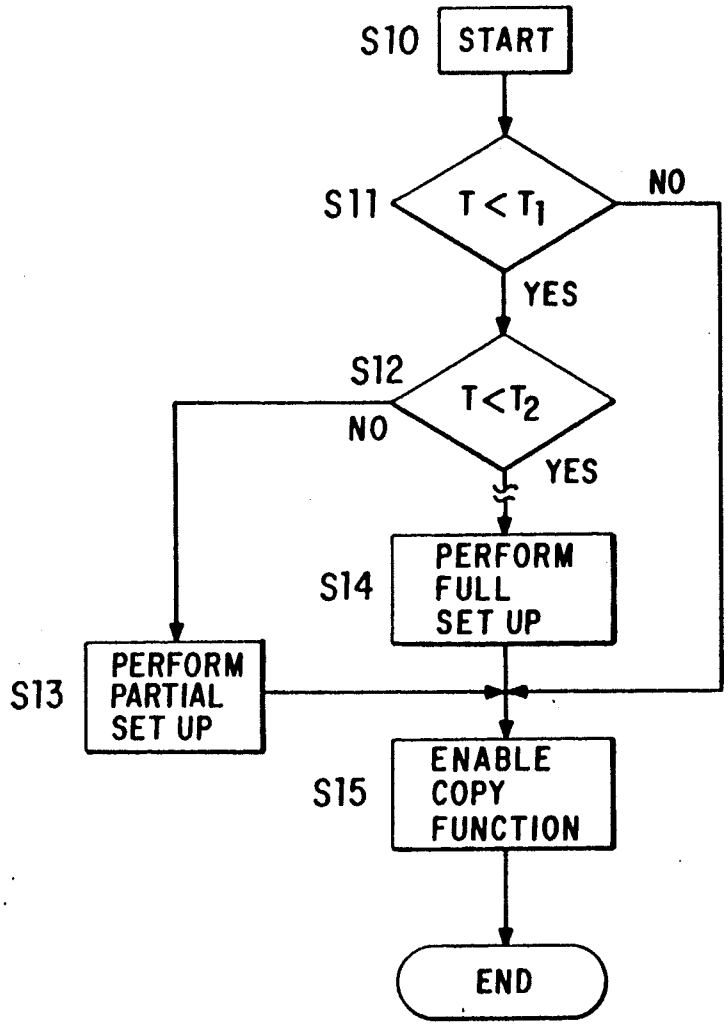
FIG. 5 is a logic diagram of a second embodiment of bypass system utilizing the invention.

In FIG. 5, a second embodiment of bypass system is shown wherein two or more temperatures, $T_1$, $T_2$ are used to provide measures of time for controlling machine setup systems. Power up of the machine occurs at S10 and processing flows to S11. If a negative determination is made at S11, that the measured temperature is not below a first predetermined temperature $T_1$, processing flows to step S15 thereby immediately enabling the copy function, as in the embodiment of FIG. 4. If the determination made at S11 is affirmative, processing flows to S12 to determine if the measured temperature T exceeds a second predetermined temperature $T_2$ which is less than $T_1$. $T_2$ is chosen to represent an elapse of time from the power shut off that requires a partial setup procedure, for example, of the illumination subsystem and/or the photoreceptor charge subsystem, but does not require a full set up procedure. If the determination at S12 is negative, processing flows to S13, wherein the partial setup routine is implemented and thereafter, processing flows to S15 thereby enabling the copy function. This occurs when the measured temperature is between the predetermined temperatures $T_1$ and $T_2$. If the determination at S12 is positive, processing flows to step 14 at which the full setup routine is performed. Thereafter processing flows to step S15 to enable the copy function. It should be realized that in the FIG. 5 embodiment, steps S13 and S14 include the inquiry process of step S4 in the FIG. 4 embodiment.

If additional intermediate determinations are desirable for truncating the full setup system, steps S11 and S12 can be replicated with additional like steps each controlling a desired level of setup, thereby reaching the copy enable function more quickly. The bypass procedures of FIGS. 4 and 5 can be implemented in software stored, for example, in memory 115.

The invention provides the overall advantage that the reprographic machine 5 can be returned to operation more quickly after brief stoppages, thereby increasing throughput of the machine and lessening operator irritation. Another advantage of the specific embodiment disclosed is that elements already present within the reprographic apparatus 5 for other purposes can perform a clock function, without the need to provide a separate clock, thereby providing for inexpensive implementation of the invention.

What is claimed is:

1. A reprographic apparatus having a plurality of monitored subsystems comprising:

a power switch actuatable between a power on position and a power off position;

a setup system for determining the existence of operable conditions of each of said plurality of monitored subsystems when said power switch switches to said power on position, said setup system including enabling means for enabling operation of the reprographic apparatus when the setup systems determines that said plurality of monitored subsystems are operable, said setup system preventing operation of said apparatus until operability is determined;

a timer for determining a time period that said power switch is in the off position; and bypass means for bypassing the setup system to enable operation of the reprographic apparatus in the absence of a determination of operable conditions at said monitored subsystem by said setup system when the time period that said power switch has been in the off position is determined to be less than a predetermined time interval.

2. The reprographic apparatus as in claim 1, wherein at least one of the monitored subsystems includes an element heated to a temperature above an ambient temperature within the reprographic apparatus during operation and the timing means includes means for determining the temperature of the heated element.

3. The reprographic apparatus as in claim 2, wherein the element is a fuser roll.

4. The reprographic apparatus as in claim 2, wherein the element is an electric motor.

5. Apparatus having a plurality of monitored subsystems comprising:

a setup system for determining the existence of operable conditions of each of said plurality of monitored subsystems, said set-up system including enabling means for enabling operation of the apparatus when the setup system determines that said plurality of monitored subsystems are operable;

an element, located within one of said monitored subsystems, heated to a temperature above an ambient temperature during operation; and bypass means for bypassing the setup system to enable operation of the apparatus in the absence of a determination of operable conditions at said monitored subsystems by said setup system, said bypass means including timing means having means for determining the temperature of the heated element.

6. Apparatus as in claim 5, wherein the element is electrically heated.

7. A method for controlling a reprographic apparatus having a plurality of monitored subsystems comprising the steps of:

providing a setup system for determining the state of operability of each of the monitored subsystems;

enabling production of a copy after the setup system determines that each subsystem is operable;

temporarily interrupting power supplied to the reprographic apparatus;

determining the time duration of the power interruption; and resuming apparatus operation after the temporary power interruption by bypassing the setup system to enable production of a copy when the determined time duration is less than a predetermined time period.

8. The method as in claim 7, wherein the step of determination of the time duration includes sensing the temperature of an element heated during operation of the reprographic apparatus.

* * * * *